US008833267B2

(12) United States Patent
Six et al.

(10) Patent No.: US 8,833,267 B2
(45) Date of Patent: Sep. 16, 2014

(54) RAIL VEHICLE WITH VARIABLE AXIAL GEOMETRY

(75) Inventors: Klaus Six, Stainztal (AT); Martin Teichmann, Graz (AT)

(73) Assignee: Siemens AG Oesterreich, Wien (AT)

( * ) Notice: Subject to any disclaimer, the term of this patent is extended or adjusted under 35 U.S.C. 154(b) by 0 days.

(21) Appl. No.: 13/636,364

(22) PCT Filed: Mar. 28, 2011

(86) PCT No.: PCT/EP2011/054719

§ 371 (c)(1),
(2), (4) Date: Sep. 21, 2012

(87) PCT Pub. No.: WO2011/120915

PCT Pub. Date: Oct. 6, 2011

(65) Prior Publication Data

US 2013/0019775 A1 Jan. 24, 2013

(30) Foreign Application Priority Data

Mar. 29, 2010 (EP) ..... 10158173

(51) Int. Cl.
*B61D 1/00* (2006.01)
*B61F 5/38* (2006.01)

(52) U.S. Cl.
CPC ..... *B61F 5/38* (2013.01)
USPC ..... 105/165; 105/166; 105/167

(58) Field of Classification Search
USPC ..... 105/165–172
See application file for complete search history.

(56) References Cited

U.S. PATENT DOCUMENTS

| | | | | | |
|---|---|---|---|---|---|
| 1,670,706 | A * | 5/1928 | Anderson | 105/174 |
| 1,954,705 | A * | 4/1934 | Kruckenberg et al. | 105/168 |
| 4,542,700 | A * | 9/1985 | Smith | 105/166 |
| 4,823,706 | A * | 4/1989 | McSweeney | 105/165 |
| 5,375,533 | A * | 12/1994 | Schwendt | 105/166 |
| 5,429,056 | A * | 7/1995 | Pees et al. | 105/168 |
| 5,555,816 | A * | 9/1996 | Jones | 105/168 |
| 5,603,265 | A * | 2/1997 | Jones | 105/167 |
| 6,966,266 | B1 * | 11/2005 | Schwendt | 105/167 |
| 8,276,522 | B2 * | 10/2012 | Simson | 105/168 |
| 8,485,109 | B2 | 7/2013 | Dietmaier et al. | |
| 2010/0229753 | A1 * | 9/2010 | Kikko et al. | 105/4.4 |
| 2012/0037031 | A1 * | 2/2012 | Okubo et al. | 105/167 |
| 2012/0103228 | A1 * | 5/2012 | Elizondo | 105/141 |

FOREIGN PATENT DOCUMENTS

| | | | |
|---|---|---|---|
| DE | 576284 | C | 7/1934 |
| DE | 4142255 | A1 | 7/1993 |
| DE | 4240098 | A1 | 6/1994 |
| DE | 4424884 | A1 | 1/1996 |
| DE | 19538379 | C1 | 1/1997 |
| EP | 1652746 | A1 | 5/2006 |
| JP | S6394079 | U | 6/1988 |

(Continued)

*Primary Examiner* — Jason C Smith
(74) *Attorney, Agent, or Firm* — Laurence A. Greenberg; Werner H. Stemer; Ralph E. Locher

(57) ABSTRACT

A rail vehicle with variable axial geometry includes at least two axles, wherein a horizontal angular position of each axle with respect to the vehicle frame may be changed, and wherein the angular position of each axle is adjusted continuously during operation of the rail vehicle in such a way that a predefined lateral displacement and a predefined axial angle are achieved.

14 Claims, 2 Drawing Sheets

(56) References Cited

FOREIGN PATENT DOCUMENTS

| | | | |
|---|---|---|---|
| JP | H01132463 | A | 5/1989 |
| JP | 9226575 | A | 9/1997 |
| JP | H09226576 | A | 9/1997 |
| JP | H09263242 | A | 10/1997 |
| JP | 2001018796 | A | 1/2001 |
| WO | WO 2007006528 | A1 | 1/2007 |
| WO | 2008155185 | A1 | 12/2008 |

* cited by examiner

RAIL VEHICLE WITH VARIABLE AXIAL GEOMETRY

CROSS REFERENCE TO RELATED APPLICATIONS

This application is the US National Stage of International Application No. PCT/EP2011/054719 filed Mar. 28, 2011, and claims the benefit thereof. The International Application claims the benefits of European Patent Application No. 10158173.4 EP filed Mar. 29, 2010. All of the applications are incorporated by reference herein in their entirety.

FIELD OF INVENTION

The invention relates to a rail vehicle with variable axial geometry.

BACKGROUND OF INVENTION

The forces necessary to guide a vehicle along a railway track occur in the area of contact between wheel and rail, the wheel-rail contact. These forces are however also responsible for negative effects on the rails and wheels. Thus tangential forces, which are always associated with sliding effects and thus with friction, cause profile wear by removing material. Furthermore the forces attacking wheel and rail, with a sufficiently high level of force, cause fatigue in the material, resulting in Rolling Contact Fatigue (RCF). This results in fine cracks in the rail and/or in the wheel for example. Head checks represent a typical form of damage caused by this fatigue on the rail surface. Cracks can occur in the wheel below the surface, grow outwards and lead to larger pits. However the cracks can also occur on the surface per se, grow deeper and likewise lead to material failures, as also occurs for example in the known phenomenon of the herringbone pattern. With surface-initiated cracks there is the effect of the cracks being partly removed again by the said profile wear, with the result that a certain degree of profile wear can sometimes be desirable. As well as the running surface damage mentioned, a variety of further forms of damage, such as flat spots, material removal, cracks across running surfaces etc., also occur.

Thus particular safety relevance is attached to the wheel-rail contact, with high-speed trains too for example. Irregularities in the wheel-rail contact, caused for example by serious damage to a wheel, can lead to major consequential damage through to derailment. But light damage such as fine cracks can also lead to great difficulties, since they make maintenance work necessary and can thus result in high costs and delays in rail traffic.

A range of mechanical devices for guiding a rail vehicle on a track are thus known. Many of the known systems are based on the fact that, when a curve is negotiated, the radial positions of the wheels in the track are optimum in order to reduce the forces acting on the independent wheel sets or wheel sets of a bogie for a rail vehicle. Thus, the argument goes, the friction and therefore also the profile wear in rail-wheel contact can be reduced.

For example EP 0 600 172 A1 describes a bogie for rail vehicles in which the wheel sets are turned outwards when negotiating a curve by means of force-controlled actuators. In this patent however a radial position of the wheel sets relative to the track is not realized, but only the angle between wheel set and bogie frame is adjusted according to the radial position. Thus although favorable wear behavior obtains in many operating states, this does not correspond to the optimum.

DE 44 13 805 A1 discloses a self-steering, three-axle bogie for a rail vehicle in which the two outer wheel sets are provided with a radial control and the inner wheel set is able to be moved lateral to the direction of travel by an active actuator. The lateral forces on the outer wheel sets are reduced by this—with a suitable application of the active actuator a third of the centrifugal force acts on each wheel set. Thus all three wheel sets are included for control during negotiation of a curve, the alignment of the wheel sets to the center of the curve is improved.

A further method of this type can be found in the applicant's patent EP 1 609 691 A1.

Common to all these methods is that they aim to minimize the friction and thus the profile wear in wheel-rail contact. In these methods the position of the wheels relative to the track is influenced so that sliding effects at the point of contact are avoided or minimized. However rolling contact fatigue also causes damage to rail and wheel. To rectify this damage a certain degree of friction can even be desirable, since cracks occurring in the material can be removed at the surface by said wear. A minimum of friction thus does not always correspond to an optimum loading ratio in wheel-rail contact.

The applicant's unpublished application A942/2007 "Verfahren zur Minimierung von Laufflächenschäden and Profilverschleiß von Rädern eines Schienenfahrzeugs" (Method for minimizing running surface damage and profile wear of wheels of a rail vehicle) discloses a model-based method for optimizing the wear behavior of rail vehicle wheels. In this method the running surface wear is optimized by means of actuator-controlled displacement (lateral displacement of the independent wheel set or wheel set axles or angular displacement between the axles) on the basis of measured values determined.

In these cases various bogie geometries are provided, which makes the angular and lateral displacement of the axles possible. The so-called lateral actuators required for this render the construction of the bogie extraordinarily difficult.

SUMMARY OF INVENTION

An object is to specify a rail vehicle with variable axle geometry which can adjust any given positions (angular position and lateral displacement) of the axles determined by means of a model-based method while the rail vehicle is moving and minimize the expense of actuators required for this.

The object is achieved by a rail vehicle and by a bogie as claimed in the independent claims. Advantageous embodiments of the invention are the subject matter of dependent claims.

According to the basic thinking behind the invention, each axle of a rail vehicle is supported horizontally and able to be displaced at an angle in relation to the vehicle frame and can be changed by means of an assigned actuator during the operation of the rail vehicle continuously and independently from the other axles in its horizontal angular position, with the angular position of each axle being predetermined by an optimization method.

The inventive rail vehicle or the inventive bogie respectively are especially advantageously suitable for implementation in the method described in the unpublished application A942/2007 for optimizing the wear behavior, since the constructional outlay is very greatly simplified by the present invention. Of particular significance is the omission of a constructionally extremely complex so-called "lateral actuator". Likewise the present invention makes it possible to use constructionally simple actuators (for example hydraulic or pneumatic cylinders or electrical actuators). The method described in A942/2007 delivers as initial variables the angular position dα between two axles and what is referred to as the lateral displacement. These two variables can, with a rail vehicle in accordance with the present invention, be adjusted exclusively by adjusting the specific horizontal angle of the axles in relation to the vehicle frame, by which a quieter running of the rail vehicle and an optimized wear behavior of the wheels is achieved.

The advantage achieved by the present invention is that respective optimum values of the angular position dα and the lateral displacement can be adjusted, wherein the horizontal angle of each axle in relation to the vehicle frame is to be provided exclusively as the variable. In particular the present invention makes it possible to dispense with the lateral actuators which are very expensive in terms of their construction.

The inventive so-called asymmetric activation makes it possible by means of the asymmetric distribution of the angle dα between two axles to perform the explicit adjustment of the lateral displacement at two different angles α1 and α2 without having to provide an actuator for the lateral displacement.

A preferred embodiment of the invention is to provide a fixed point (vertical pivot point) at one end of the axle and assign an actuator which engages at the other end of the axle. This actuator is inventively attached supported on one side to a fixed point of the vehicle frame and on a second side to the horizontal angularly-displacable support of the assigned axis of the rail vehicle. By means of modulation of the length of the actuator this successfully enables any given horizontal angular positions of each axle to be achieved.

A further preferred embodiment of the invention makes provision, on successive axles, for the actuators assigned to them to engage alternately on opposing ends of the axles, so that for example an axle of which the actuator is arranged on one side of the rail vehicle is followed by an axle on which the actuator is arranged on the opposite side of the rail vehicle. This makes it possible to achieve the advantage of optimum utilization of the space available in the chassis of the rail vehicle.

Other embodiments, in which for example the actuators of all axles are provided on one side of the rail vehicle, are likewise conceivable.

A particular embodiment of the invention makes provision for embodiment of the axles of the rail vehicle as a so-called "independent wheel set", in which the wheels are supported on a shaft (axle) and can turn independently of one another.

A further embodiment of the invention provides that the use of so-called "fixed wheel sets" in which the wheels are connected rigidly to the axle.

The invention is well suited to use in a bogie of a rail vehicle.

BRIEF DESCRIPTION OF THE DRAWINGS

The drawings show the following examples.

EMBODIMENT OF THE INVENTION

Figure 1:
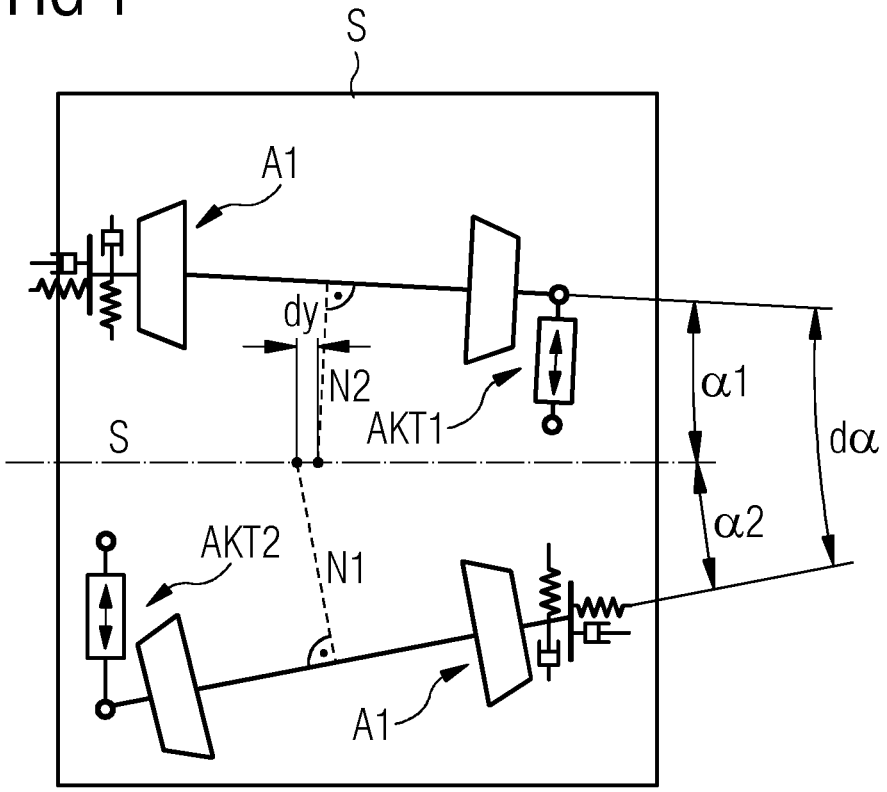
FIG. 1 shows a rail vehicle with variable axle geometry.

As an example and a schematic, FIG. 1 shows the principle structure of a rail vehicle with variable axle geometry. A rail vehicle S comprising two axles A1, A1, which are each supported horizontally around a pivot point at one end of each variable axle A1, A2. On the side of each axle A1, A2 opposite the pivot point an actuator AKT1, AKT2 engages respectively at the end of each axle A1, A2, which is connected at its other end to the frame of the rail vehicle S. By means of modulation of the length of the actuators AKT1, AKT2 a separate specific horizontal angle α1, α2 can thus be set for each axle A1, A2. If different horizontal angles α1, α2 are set for consecutive axles a lateral displacement dy and an axle angle dα of α1+α2 is produced between these axles. It is shown that as well as the axle angle dα, the lateral displacement dy has a decisive influence on the wear or damage behavior of the vehicle.

This lateral displacement dy is defined geometrically by the normals N1, N2 to the central points of the wheel axles not meeting in the plane of symmetry S of the bogie, but being at a distance from each other in this plane of symmetry S.

Inventively the lateral displacement dy together with the radial position of the axles is achieved by the explicit setting of the axle angle α1, α2 of the axles. This produces a simple and reliable option for setting the lateral displacement dy with a low expenditure on actuators.

Figure 2:
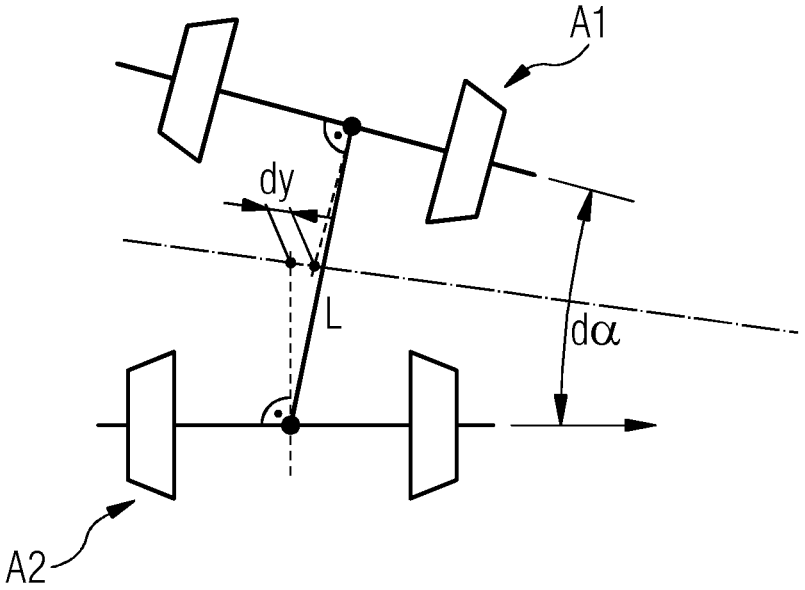
FIG. 2 shows the initial variables of a model-based method for minimizing surface running damage and profile wear.

FIG. 2 shows by way of example and as a schematic diagram the initial variables of a model-based method for minimizing surface running damage and profile wear.

A rail vehicle with two axles A1 and A2 is shown which can adopt any given horizontal angular positions (axle angle dα) in relation to each other and which exhibit a lateral displacement dy to each other. The space between the axles L corresponds to the distance between the centre points of the axles A1 and A2. The effective axle spacing, since usually only very small axle angles dα occur, can be equated approximately to the axle spacing L. The two variables axle angle dα and lateral displacement dy are defined by means of a model-based method so that inter alia an optimum where behavior of running wheels and rail profiles is achieved.

Figure 3:
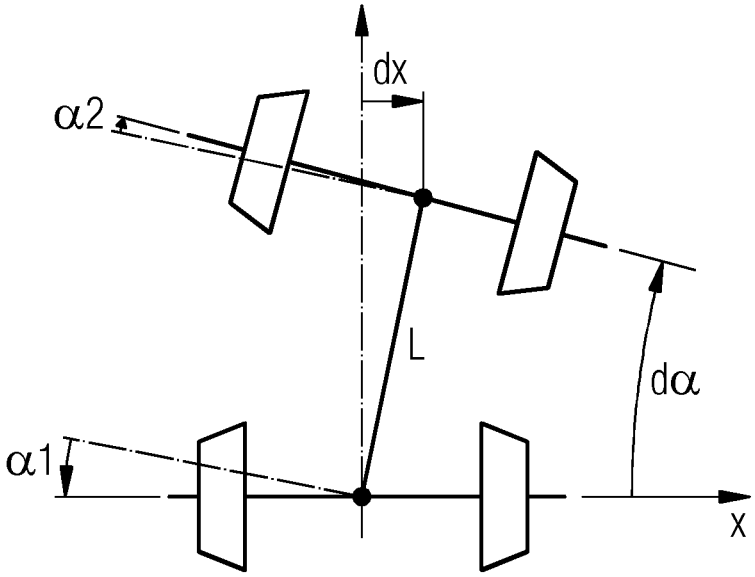
FIG. 3 shows determining the horizontal angle of each axle.

FIG. 3 shows by way of example and as a schematic diagram the determination of the horizontal angle of each axle, wherein from the predetermined variables axle angle dα and lateral displacement dy, that combination of the horizontal angle of the first axle α1 and horizontal angle of the second axle α2 is determined.

From the equations $$\alpha 1 + \alpha 2 = d\alpha$$

and $$dy = \frac{L}{2}(\sin\alpha 2 - \sin\alpha 1)$$

for small angles $$dy = \frac{L}{2}(\alpha 2 - \alpha 1)$$

the horizontal angle of the first axle α1 is approximately determined:

$$\Rightarrow \alpha 1 = \frac{d\alpha}{2} - \frac{dy}{L}$$

and the horizontal angle of the second axle α2:

$$\Rightarrow \alpha 2 = \frac{d\alpha}{2} + \frac{dy}{L}$$

Figure 4:
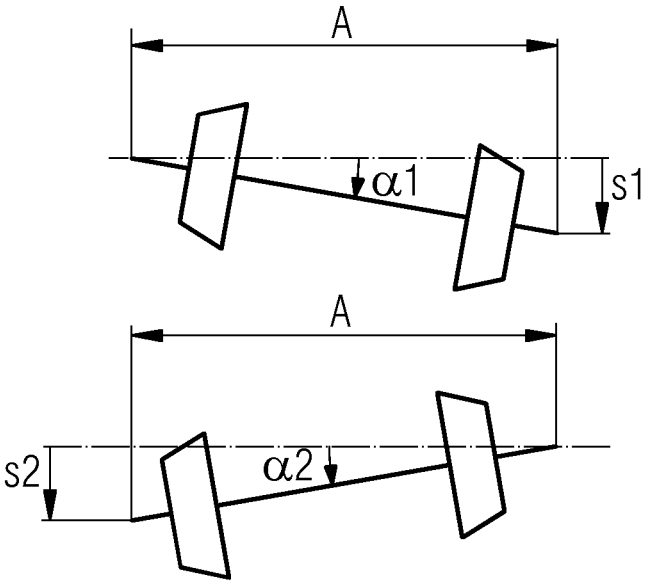
FIG. 4 shows determining the deflection of actuators.

FIG. 4 shows by way of example and as a schematic diagram the determination of the deflection of actuators for a rail vehicle in accordance with FIG. 1. The rail vehicle shown in FIG. 1 is equipped on each of the axles A1, A2 with an actuator AKT1, AKT2 in each case, which engages with the end of each axle A1, A2. From the individual angles $\alpha 1$ and $\alpha 2$ determined according to FIG. 3, with a predetermined axle length A, the required deflection of each actuator can be determined in accordance with:

$$s1=A\cdot\tan\alpha 1$$

and $$s2=A\cdot\tan\alpha 2.$$

The invention claimed is:

1. A rail vehicle with variable axle geometry, comprising:

a vehicle frame, two axles each having a horizontal angular position to be changed in relation to the vehicle frame, and two actuators each assigned to a respective one of the two axles and configured to continuously adjust the horizontal angular position of each respective axle during operation of the rail vehicle so that a predetermined lateral displacement and a predetermined axle angle are purposely achieved.

2. The rail vehicle with variable axle geometry as claimed in claim 1, wherein the predetermined lateral displacement and the predetermined axle angle are determined by a model-based method.

3. The rail vehicle with variable axle geometry as claimed in claim 1, wherein the two axles are embodied as independent wheel sets.

4. The rail vehicle with variable axle geometry as claimed in claim 1, wherein the two axles are embodied as fixed wheel sets.

5. The rail vehicle with variable axle geometry as claimed in claim 1, wherein the actuators are respectively attached to opposite sides of the axles.

6. A bogie with variable axle geometry for rail vehicles, comprising:

two axles, two actuators each assigned to a respective one of the two axles and configured to continuously adjust an angular position of each respective axle during operation of a rail vehicle so that a predetermined lateral displacement and a predetermined axle angle are purposely obtained.

7. The bogie with variable axle geometry as claimed in claim 6, wherein the predetermined lateral displacement and the predetermined axle angle are determined by a model-based method.

8. The bogie with variable axle geometry as claimed in claim 6, wherein the two axles are embodied as independent wheel sets.

9. The bogie with variable axle geometry as claimed in claim 6, wherein the two axles are embodied as fixed wheel sets.

10. The bogie with variable axle geometry as claimed in claim 6, wherein the actuators are attached to respective opposite sides of the axles.

11. A method for varying an axle geometry of a rail vehicle, the method comprising the following steps:

providing a vehicle frame;

providing two axles each having a horizontal angular position to be changed in relation to the vehicle frame; and continuously adjusting the horizontal angular position of each axle during operation of the rail vehicle so that a predetermined lateral displacement and a predetermined axle angle are purposely achieved.

12. The method according to claim 11, which further comprises carrying out the continuous adjustment step by using two actuators each attached to respective opposite sides of a respective one of the axles.

13. A method for varying an axle geometry of a bogie for rail vehicles, the method comprising the following steps:

providing two axles; and continuously adjusting an angular position of each respective axle during operation of the rail vehicle so that a predetermined lateral displacement and a predetermined axle angle are purposely obtained.

14. The method according to claim 13, which further comprises carrying out the continuous adjustment step by using two actuators each attached to respective opposite sides of a respective one of the axles.

* * * * *